US009010156B2

(12) United States Patent
Hoffman

(10) Patent No.: US 9,010,156 B2
(45) Date of Patent: Apr. 21, 2015

(54) SIMPLIFIED SINGLE-KNIT CIRCULAR KNITTING MACHINE

(75) Inventor: Ulrich Hoffman, Albstadt (DE)

(73) Assignee: Hugo Kern & Liebers GmbH & Co. KG, Schramberg (DE)

( * ) Notice: Subject to any disclaimer, the term of this patent is extended or adjusted under 35 U.S.C. 154(b) by 0 days.

(21) Appl. No.: 13/990,126

(22) PCT Filed: Dec. 15, 2011

(86) PCT No.: PCT/EP2011/006347

§ 371 (c)(1),
(2), (4) Date: Jul. 9, 2013

(87) PCT Pub. No.: WO2012/079763

PCT Pub. Date: Jun. 21, 2012

(65) Prior Publication Data

US 2013/0276482 A1 Oct. 24, 2013

(30) Foreign Application Priority Data

Dec. 15, 2010 (DE) ..... 10 2010 054 540

(51) Int. Cl.
*D04B 15/06* (2006.01)
*D04B 9/06* (2006.01)
(Continued)

(52) U.S. Cl.
CPC *D04B 9/06* (2013.01); *D04B 15/06* (2013.01); *D04B 15/322* (2013.01); *D04B 15/34* (2013.01)

(58) Field of Classification Search
CPC ..... D04B 15/06; D04B 15/24; D04B 15/32
USPC ..... 66/104, 106, 111, 8, 13
See application file for complete search history.

(56) References Cited

U.S. PATENT DOCUMENTS 1,244,270 A * 10/1917 Wilcomb ..... 66/100
2,012,095 A 8/1935 Cole
(Continued)

FOREIGN PATENT DOCUMENTS

DE 23 65 274 A 7/1974
DE 38 12 240 A1 10/1989
(Continued)

OTHER PUBLICATIONS

International Search Report issued by WIPO for priority application PCT/EP2011/006347, listing SU 1 137 791 A1 as a "document of particular relevance", Jun. 14, 2012.
(Continued)

*Primary Examiner* — Danny Worrell
(74) *Attorney, Agent, or Firm* — Todd L. Juneau

(57) ABSTRACT

In the case of a single circular knitting machine consisting of a central rotatable needle cylinder (Z), around which a sinker ring (PR) comprising sinkers (P) as well as stationary cam systems (S) are arranged, which act on the needles (1), which are in each case assigned to the sinkers (P) and which can be moved vertically up and down, so as to replace the pitches, which hit one another rigidly, with a sinker grid system, which is flexible per se, which is automatically oriented in the needle gaps, a rocker (44) comprising an upper and a lower control bump (45) being provided in each case on the end of the sinkers (P), which is spaced apart from the needle, the sinker ring (PR), at the end below the sinkers (P), which is spaced apart from the needle, is embodied as a pivot point projection (40) comprising pivot point slits (41), in which the sinkers (P) are accommodated with their pivot inlet (43) so that they are capable of being tilted and the sinkers (P) being are laterally fixed in the needle gaps with sliding noses (47) at the end, which is spaced apart from the needle, transport the last knitting loops to the needle shaft (1) behind the needle latches in response to the knitting loop formation.

22 Claims, 11 Drawing Sheets

(51) Int. Cl.
*D04B 15/32* (2006.01)
*D04B 15/34* (2006.01)

(56) References Cited

U.S. PATENT DOCUMENTS

| | | | | | |
|---|---|---|---|---|---|
| 3,540,237 | A | | 11/1970 | Agulnek | |
| 3,643,472 | A | * | 2/1972 | Apprich | 66/106 |
| 3,754,416 | A | * | 8/1973 | Apprich | 66/106 |
| 3,857,258 | A | | 12/1974 | Agulnek et al. | |
| 4,574,596 | A | * | 3/1986 | Engelfried et al. | 66/104 |
| 4,576,018 | A | * | 3/1986 | Schindele | 66/106 |
| 4,608,841 | A | * | 9/1986 | Buck et al. | 66/104 |
| 4,693,092 | A | * | 9/1987 | Plath | 66/55 |
| 4,741,181 | A | * | 5/1988 | Plath | 66/104 |
| 6,401,495 | B2 | * | 6/2002 | Eppler et al. | 66/106 |
| 6,568,222 | B1 | * | 5/2003 | Morita | 66/106 |
| 7,980,100 | B2 | * | 7/2011 | Lonati et al. | 66/106 |

FOREIGN PATENT DOCUMENTS

| | | | | |
|---|---|---|---|---|
| DE | 100 15 730 | A1 | | 10/2001 |
| SU | 1 127 791 | A | | 12/1984 |
| SU | 1 137 791 | A1 | | 4/1988 |
| SU | 1137791 | A | * | 4/1988 |

OTHER PUBLICATIONS

Office Action from corresponding Chinese Patent Office, dated Apr. 28, 2014.

* cited by examiner

SIMPLIFIED SINGLE-KNIT CIRCULAR KNITTING MACHINE

CROSS REFERENCE TO RELATED APPLICATIONS

This patent application claims priority to International Patent Application PCT/EP2011/006347, filed on Dec. 15, 2011, and thereby to German Patent Application 10 2010 054 540.6, filed on Dec. 15, 2010.

STATEMENT REGARDING FEDERALLY SPONSORED RESEARCH OR DEVELOPMENT

No federal government funds were used in researching or developing this invention.

NAMES OF PARTIES TO A JOINT RESEARCH AGREEMENT

Not applicable.

SEQUENCE LISTING INCLUDED AND INCORPORATED BY REFERENCE HEREIN

Not applicable.

BACKGROUND

1. Field of the Invention

The invention relates to a single circular knitting machine, consisting of a central rotatable needle cylinder (Z), around which a sinker ring (PR), which rotates simultaneously, comprising sinkers (P) as well as stationary cam systems (S), which act on the needles (1), which are in each case assigned to the sinkers (P) and which can be moved vertically up and down.

2. Background of the Invention

The current state of knowledge is as follows.

Single circular knitting machines are an important branch in the use of knitting machines. Over decades, a structural design has thereby established itself, which has since not been questioned anymore. The basic elements of all of the single circular knitting machines, which are available today, are the central needle cylinder comprising the needle slots for the latch needles arranged on the periphery, of an invention from the year 1852. In response to the knitting loop formation process, the needles are moved back and forth by means of control bases, which stick out of the periphery, via control curves in sector cam systems, which are arranged side by side on the periphery. When pushing the latch needles forward, the last knitting loop, which is located in the hook, must open the latch and must overcome the increasing interior latch surface, so that it reaches the needle shaft behind the latch. A sinker ring, which is connected to the cylinder and which comprises sinkers arranged in horizontal slots, the pitch of which is staggered relative to the needles, ensures that the knitted fabric is thereby not lifted off the upper cylinder edge (=cast-off edge). The movements of the sinkers must be accurately coordinated with those of the needles. This is carried out in a laborious manner by means of a sinker cam plate, which is stationary in the space above the sinker ring and to which the sector-like sinker cams are fastened on the bottom, said sinker cams move the sinkers, which are also provided with control bases, back and forth when they are rotated past in operative connection with the needles. An adjusting possibility, which is not easily accessible, is thereby necessary in the sinker cams.

The enumeration makes it clear that many different courses of movement and functions take place simultaneously within a very small space of the knitting loop formation and that the stationary control systems, which are necessary for this, must be available. The demands on the accuracy have been increased extremely due to the needle pitches, which become finer and finer, so that fewer and fewer manufacturers can meet them, that is, a selection of only a few, who remain and who rule the market, is created. To alleviate the demands on accuracy, which meet in a confined space, the pitches of the cylinder and of the sinker ring, which meet directly, are particularly difficult.

BRIEF SUMMARY OF THE INVENTION

In a preferred embodiment, a single circular knitting machine consisting of a central rotatable needle cylinder (Z), around which a sinker ring (PR), comprising sinkers (P) as well as cam systems (S) are arranged, which act on the needles (1), which are in each case assigned to the sinkers (P) and which can be moved vertically up and down, characterized in that the sinkers (P) encompass a rocker (44) comprising an upper and a lower control bump (45) in each case on the end, which is spaced apart from the needle, that the sinker ring (PR) at the end below the sinkers (P), which is spaced apart from the needle, is embodied as a pivot point projection (40) comprising pivot point slits (41), in which the sinkers (P) are accommodated so that they are capable of being tilted with their pivot inlet (43) and in that they are laterally fixed in the needle gaps with sliding bumps (47) at the end, which is spaced apart from the needle, such that the last knitting loops are transported to the needle shaft (1) behind the needle latches in response to the knitting loop formation.

In another preferred embodiment, the machine as disclosed, characterized in that the angle of inclination (a) of the sinker (P) and the x-y deflection of the sliding bump (47) are determined by means of the arrangement of the pivot point (42) of the sinker (P) at the outer diameter of the sinker ring (PR) with the distance dimensions (a, b) to the needle base and (c) to the cast-off edge of the cylinder (Z).

In another preferred embodiment, the machine as disclosed, characterized in that the sinker (P) encompasses a template (46) at the front, which transitions downwards into the sliding bump (47), for the insertion of the thread into the needle hook (2).

In another preferred embodiment, the machine as disclosed, characterized in that the sliding bump (47) of the sinker (P) can be controlled such that it clamps the last knitting loop on the upper edge of the needle slot side walls of the cylinder (Z) when the new thread loop is pulled through.

In another preferred embodiment, the machine as disclosed, characterized in that the sinker (P) forms the pivot point (42) in a pivot inlet (43) and is connected to a rocker (44), which is widened upwards and downwards, and the control bumps (45) of which on the end side encompass sliding surfaces for the pivot movement.

In another preferred embodiment, the machine as disclosed, characterized in that control cams (49), which are fastened in a support rail (48) on the cam system (S) as unit (E), are assigned to the control bumps (45) of the rocker (44), that the counterbalance (50) of the sinker (P) around the pivot point (42) is arranged between the control curves (49) and that the upper control cam (49) preferably includes mini slide or ball bearings.

In another preferred embodiment, the machine as disclosed, characterized in that the sinker ring (PR) encompasses an additional guide rim (51) comprising slits, which are laterally aligned with the pivot point slits (41), in the effective range of the lower control bump (45).

The machine according to one of claims 1 to 7, characterized in that the sinker ring (PR), at its lower front surface, encompasses position slits (39), which are laterally aligned with the pivot point slits (41) and which can be inserted into the nose projections (38) at the cylinder insertion bars, which are known per se, whereby the pivot point slits (41) are oriented according to the needle gaps to a sufficiently accurate extent.

In another preferred embodiment, the machine as disclosed, characterized in that spacing bumps H or spacing springs or space maintainers are attached to the sinkers (P) above the cavity between needle cylinder (Z) and sinker ring (PR) such that they encompass the entire needle pitch at this location.

In another preferred embodiment, the machine as disclosed, characterized in that the space maintainer is embodied as a U-shaped slide.

In another preferred embodiment, the machine as disclosed, characterized in that the sinker shaft encompasses the full pitch distance above the cavity between needle cylinder (Z) and sinker ring (PR) and narrows laterally forwards for the engagement with the needle gaps, while lateral depressions, which form a guide latch (52) with the thickness of the pivot point slits (41), are preferably impressed in the back of the pivot inlet (43).

In another preferred embodiment, the machine as disclosed, characterized in that the sinker ring (PR) encompasses a plate area, which is embodied in particular so as to be flat.

In another preferred embodiment, the machine as disclosed, characterized in that the pivot point projection is embodied as an endless thread, which is arranged in a revolving groove, which is arranged in the outer periphery of the sinker ring.

In another preferred embodiment, the machine as disclosed, characterized in that the endless thread is made of rubber or highly elastic carbon or is embodied as a coil spring ring.

In another preferred embodiment, the machine as disclosed, characterized in that the thickness of the sinker (P) encompasses the full pitch distance at least at a distance to the end on the needle side.

A sinker for a single circular knitting machine, characterized in that the sinkers (P) encompass a rocker (44) comprising an upper and a lower control bump (45) in each case on the end, which is spaced apart from the needle, as well as a pivot inlet (43), wherein the thickness of the sinker (P) encompasses the full pitch distance at least at a distance to the end on the needle side.

In another preferred embodiment, the sinker as disclosed, characterized in that the sinker encompasses a spacing bump or a spacing spring or a space maintainer, which is preferably embodied as a (U-shaped slide, at a distance to the end on the needle side.

In another preferred embodiment, the sinker as disclosed, characterized in that the sinker shaft narrow laterally forwards, starting at the distance to the end on the needle side, in which it encompasses the full pitch distance, for the engagement with the needle gaps, while lateral depressions, which form a guide latch (52) with the thickness of the pivot point slits (41), are preferably impressed in the back of the pivot inlet (43).

Each of FIGS. 2 to 6 shows two different sinker alternatives for different fineness demands.

Figure 2:
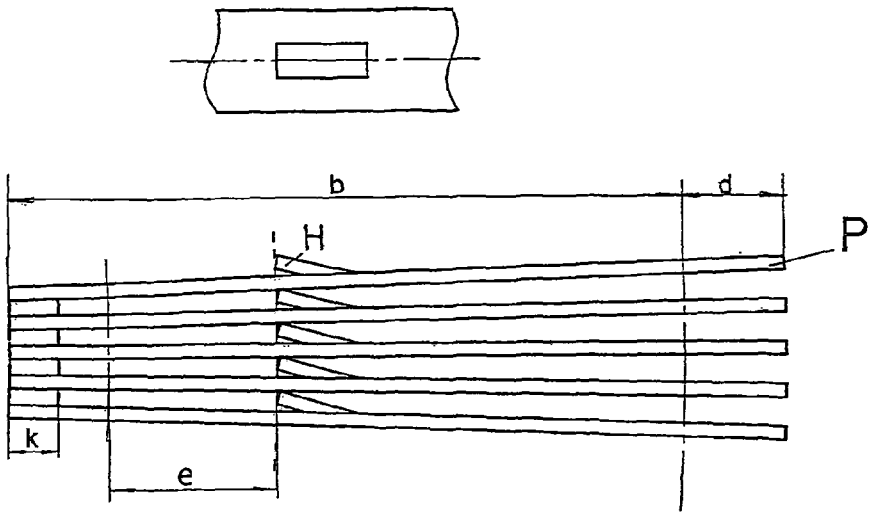

FIG. 2 shows the embodiment for average pitch fineness with the largest range of application.

Figure 3:
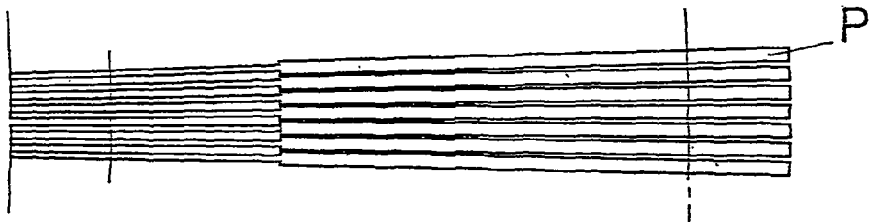

FIG. 3 shows the embodiment for ultra-fine needle pitches with sinkers (P), which are stable for this purpose.

Figures 4, 5, 6:
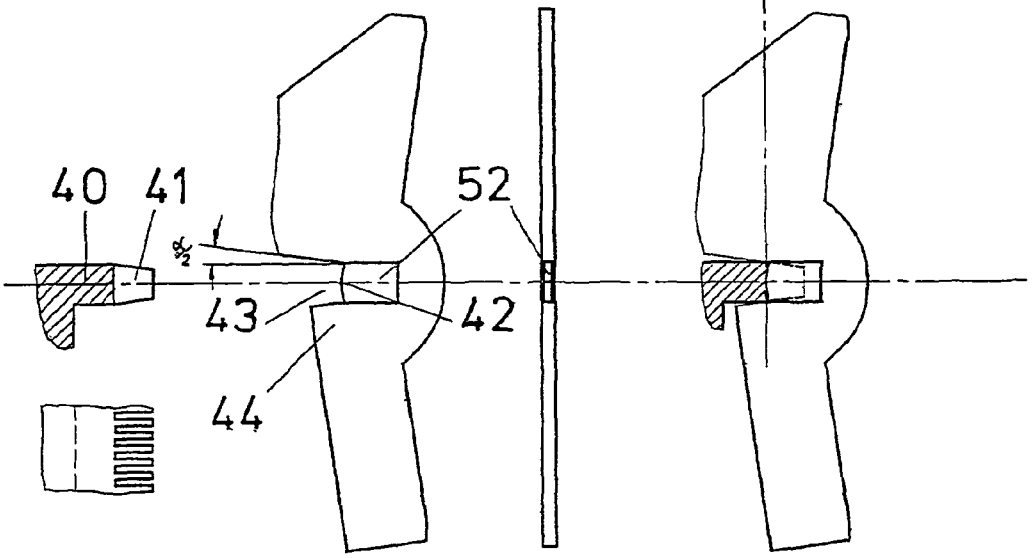

FIG. 4 shows the embodiment of the pivot point projection (40) according to the alternative of FIG. 3.

FIG. 5 shows views of the sinker (P) with view from the left onto and from the right into the pivot inlet (43).

FIG. 6 shows the pivot point area of the sinker (P), which is introduced into the pivot point slit (41).

Figure 7:
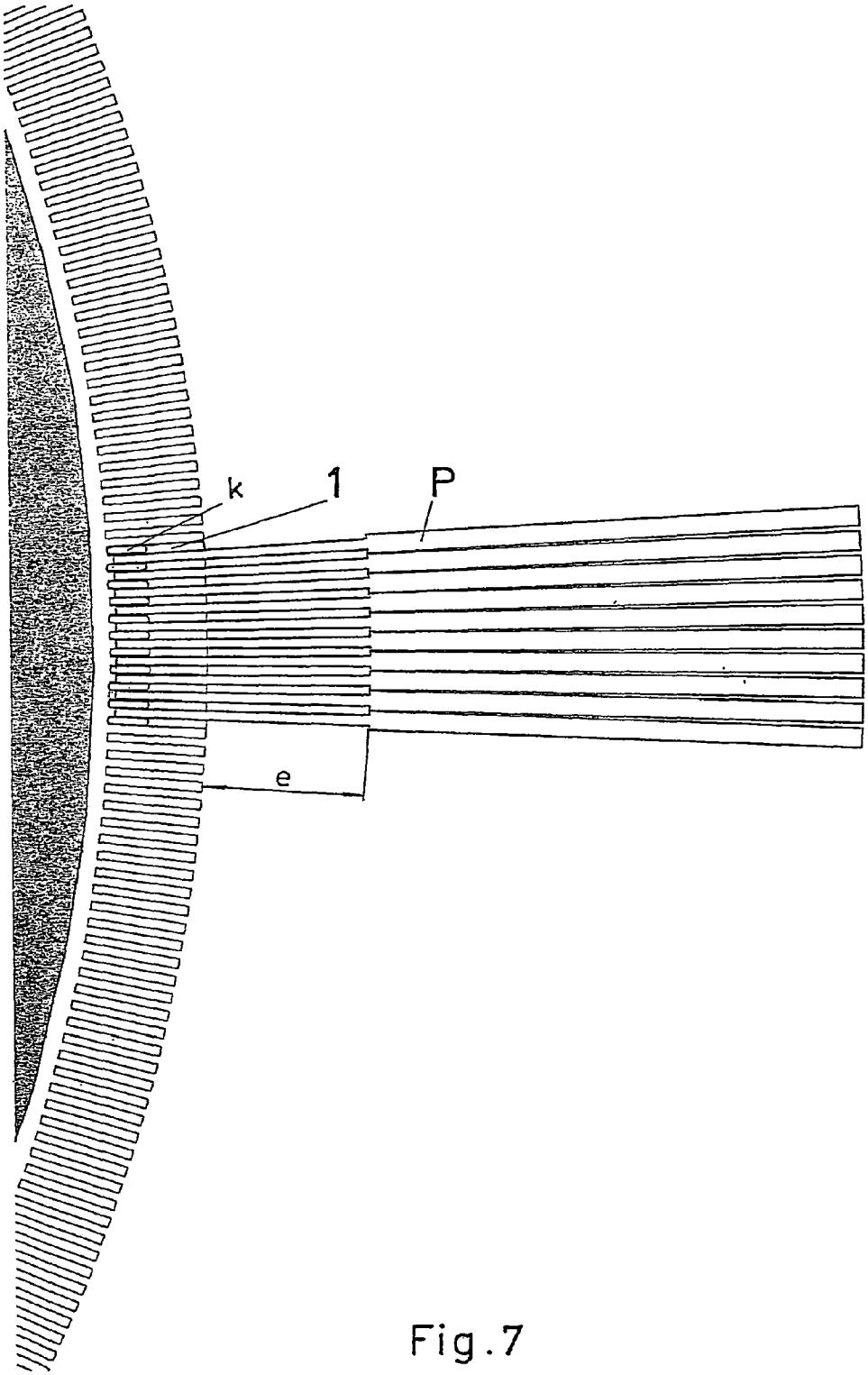

FIG. 7 shows the view from the top onto a formation of grid sinkers and onto the upper cylinder edge (Z).

Figure 8:
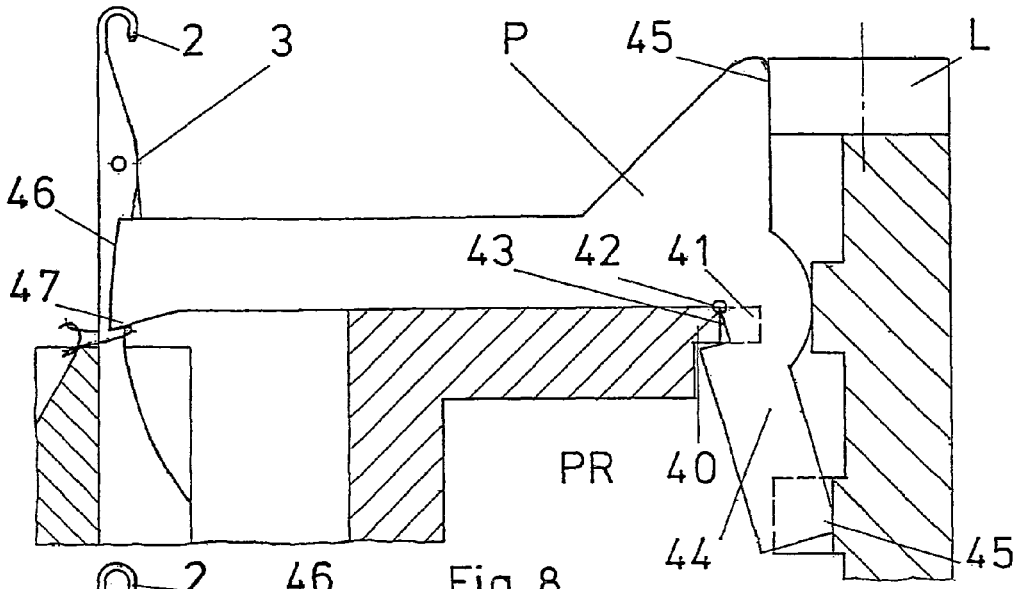

FIG. 8 shows the partial section on the top through cylinder (Z) and sinker ring (PR) with exposed needle (1) and the sinker (P) in the lower end position.

Figure 9:
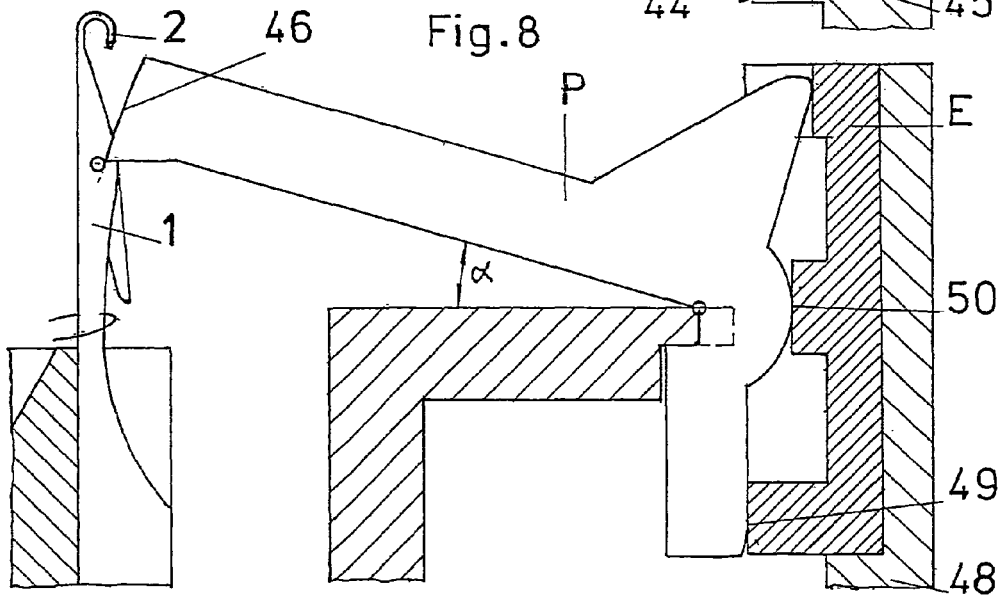

FIG. 9 shows the arrangement according to FIG. 8 in the upper end position.

Each of FIGS. 10 to 14 shows the positions of the sliding bump (47) to the needle movement (1) in response to the formation of knitting loops.

Figures 10, 11, 12, 13, 14:
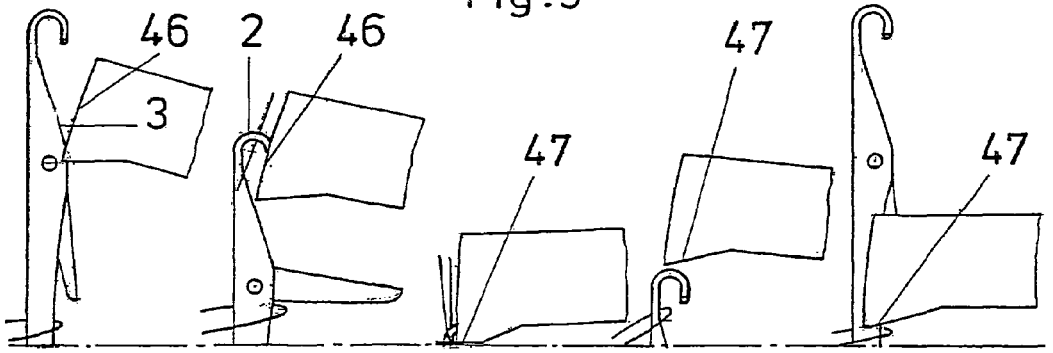

FIG. 10 shows the cast-out position of the needle (1) with the sliding bump (47) being pivoted upwards for the insertion of the thread by means of the template (46).

FIG. 11 shows the insertion of the thread into the needle hook (2) in response to the return movement of the needle (1) and in response to simultaneous small downwards movement of the sliding bump (47).

FIG. 12 shows the clamping of the last knitting loop before pulling the new thread through on the upper edge of the needle cylinder with the sliding bumps (47).

FIG. 13 shows the upwards movement of the sliding bump (43) into the capture position, so as to capture the new knitting loop, which hangs in the hook after the kinking in response to the forward movement of the needle (1) and, as can be seen in, FIG. 14, to bring it behind the open latch.

Figure 15:
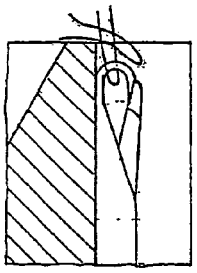
Figure 16:
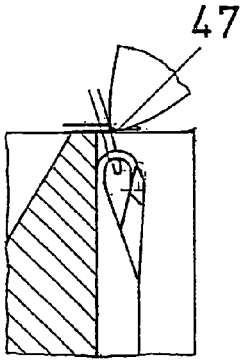
Figure 17:
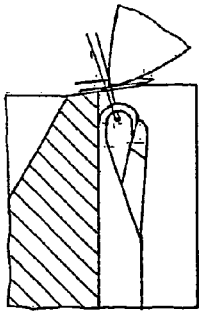

Each of FIG. 15 to FIG. 17 shows the difference of the knitting loop behavior according to the invention in response to the kinking.

FIG. 15 shows the knitting loop behavior in response to the current kinking.

FIG. 16 shows the holding of the last knitting loop in response to the kinking.

FIG. 17 shows a possible advantageously small bevel of the upper edge of the needle cylinder in the area of the threading.

Figure 18:
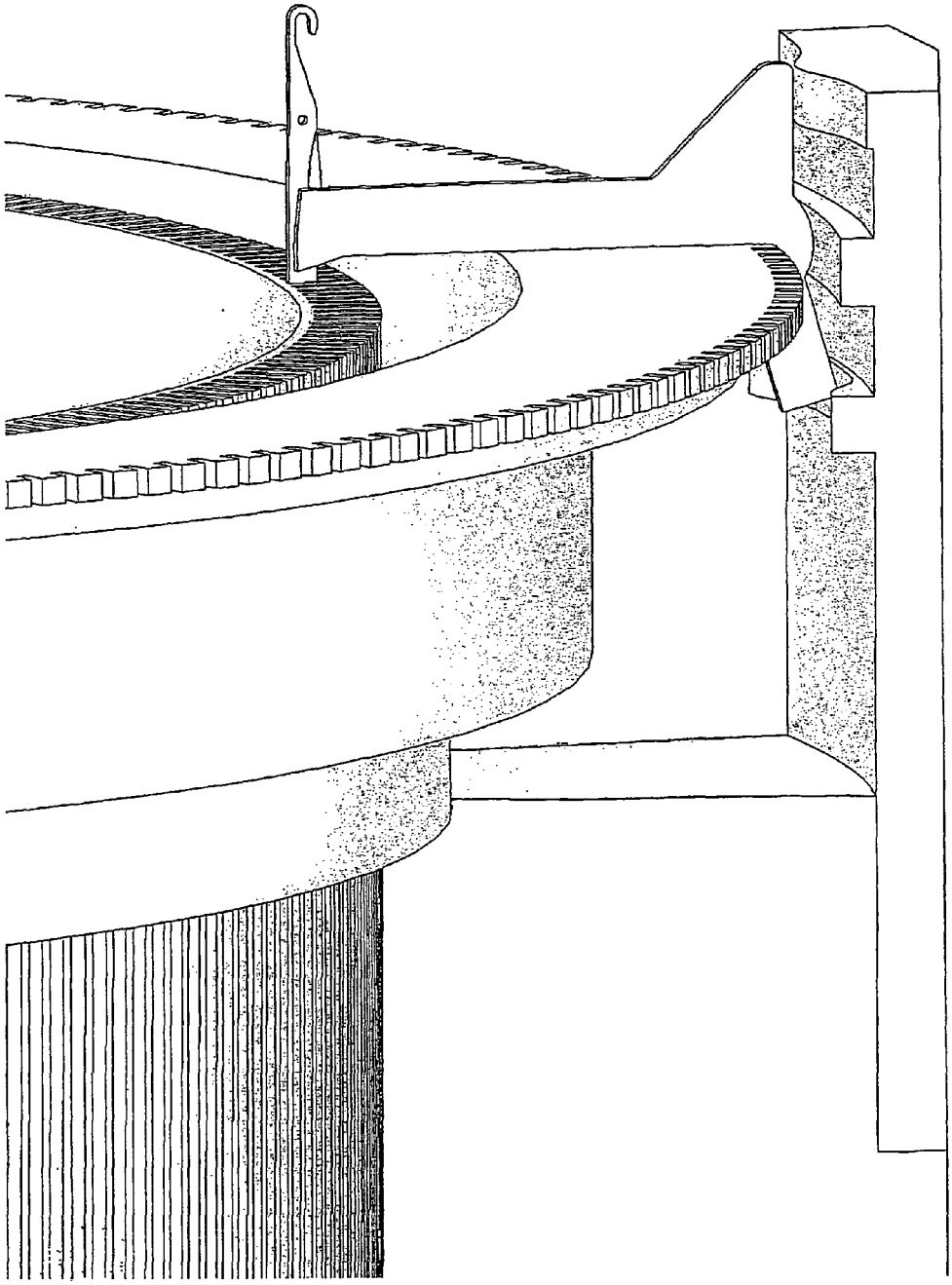

FIG. 18 shows the three-dimensional illustration of the central structural unit single circular knitting machine, consisting of needle cylinder sinker ring with grid sinker cam system with needle and sinker control.

Figure 19:
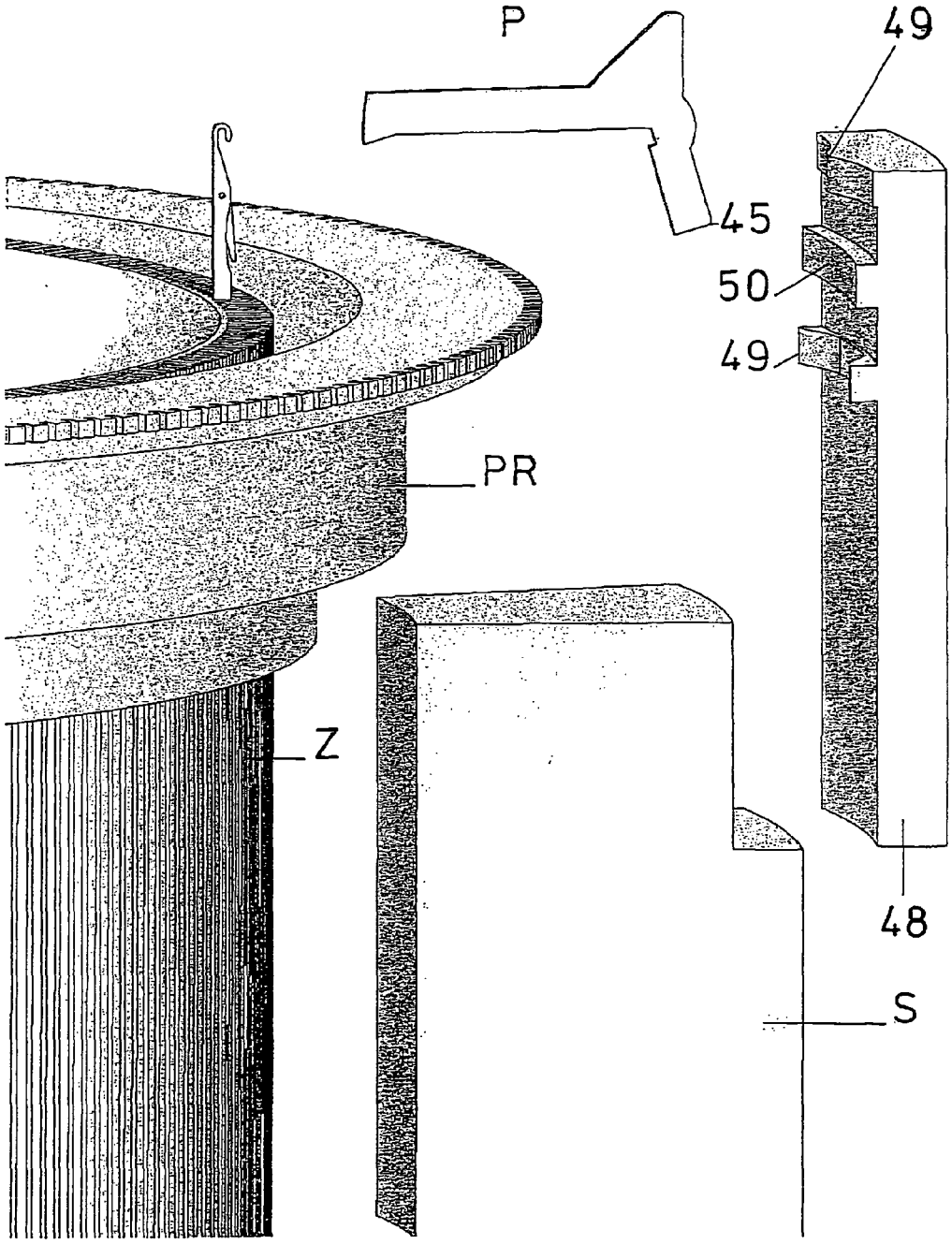

FIG. 19 shows the exploded illustration of the components needle cylinder with needle and sinker ring-grid sinker-cam system for needle control-sinker control.

Figure 20:
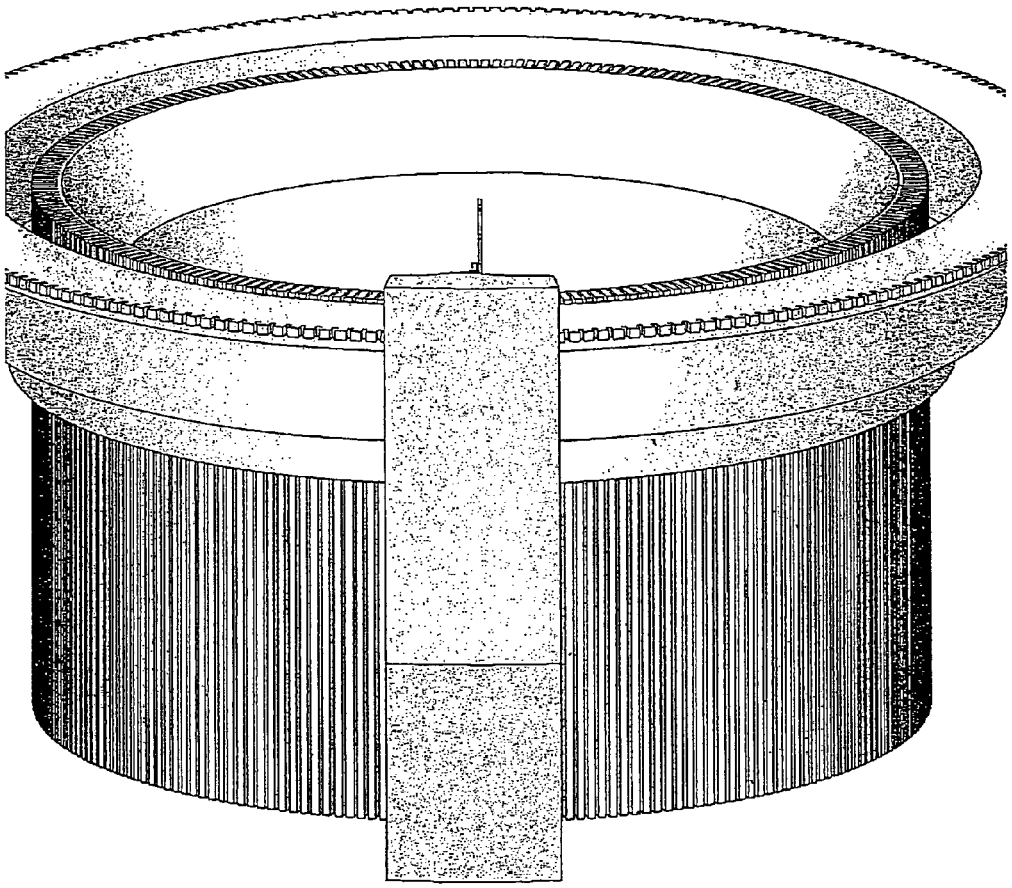
Figure 21:
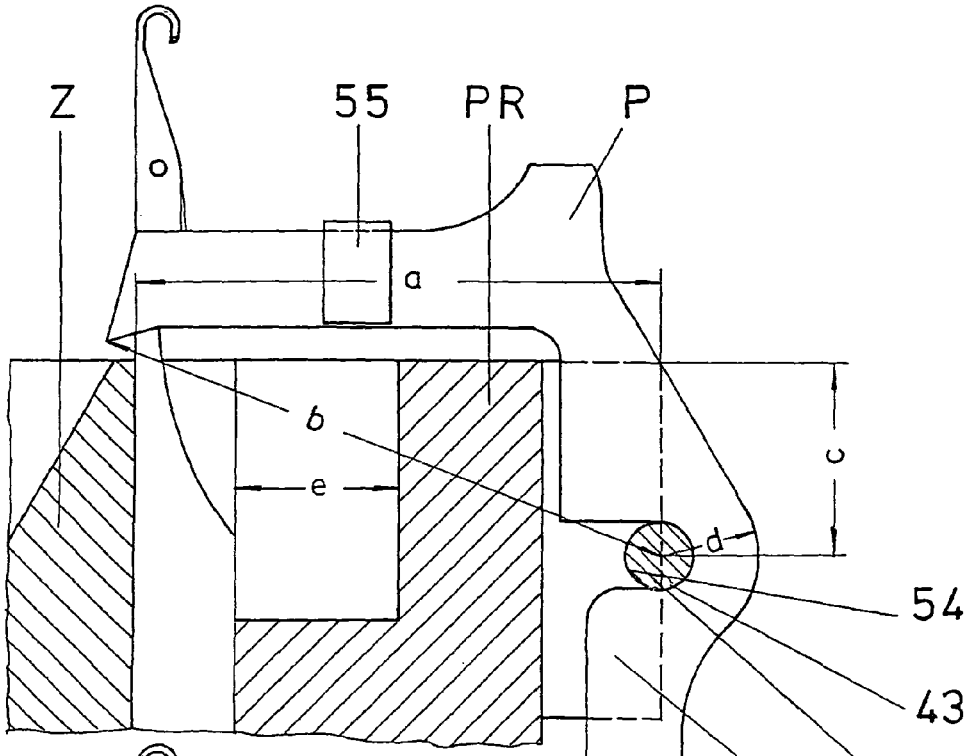

FIG. 20 shows the view from the front onto the simplified structural design single circular knitting machine with the combined cam system for the control of the needles and of the grid sinkers;

FIG. 21 shows the partial section on the top through cylinder (Z) and sinker ring (PR) with exposed needle (1) and the sinker (P) in the lower end position in an alternative embodiment of the invention.

Figure 22:
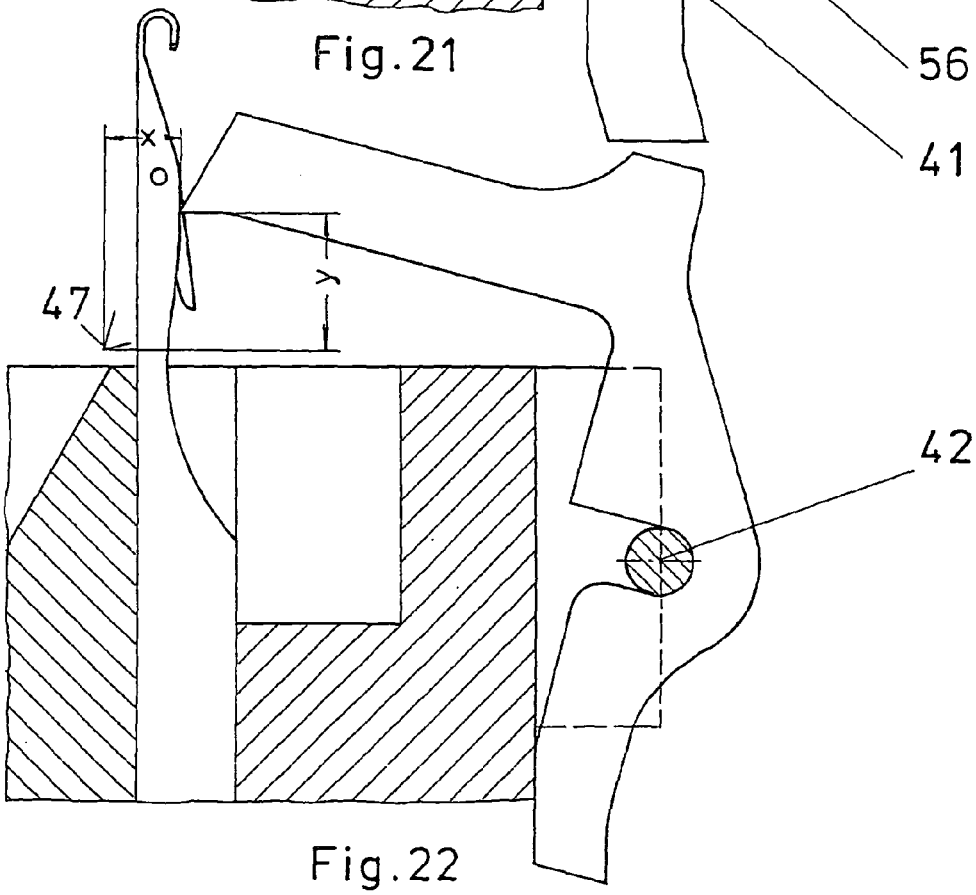

FIG. 22 shows the arrangement according to FIG. 21 in the upper end position.

Figure 23A:
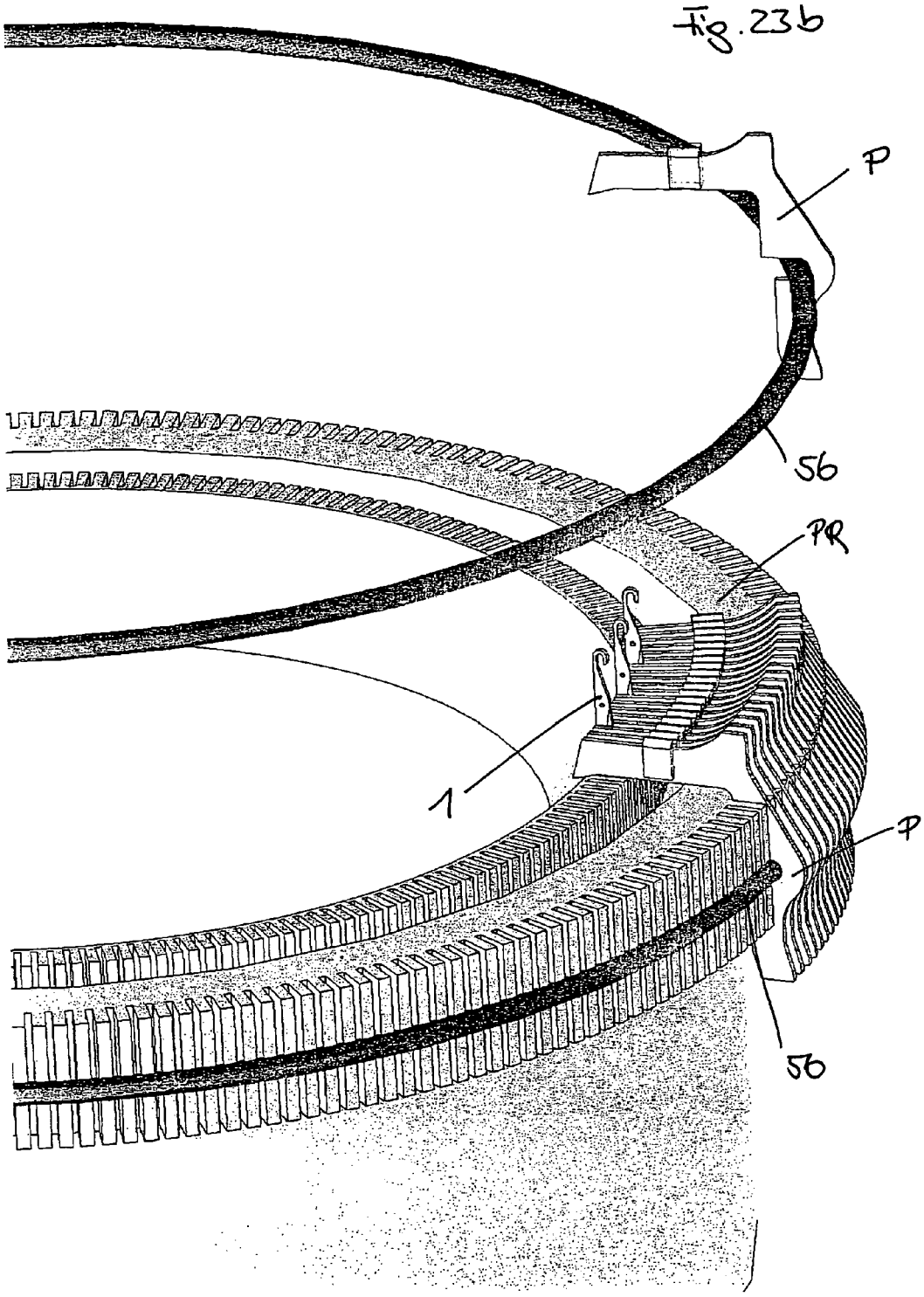

FIG. 23*a* shows the three-dimensional illustration of the central structural unit of an alternative embodiment of a single circular knitting machine, consisting of needle cylinder, sinker ring and sinkers.

Figure 24:
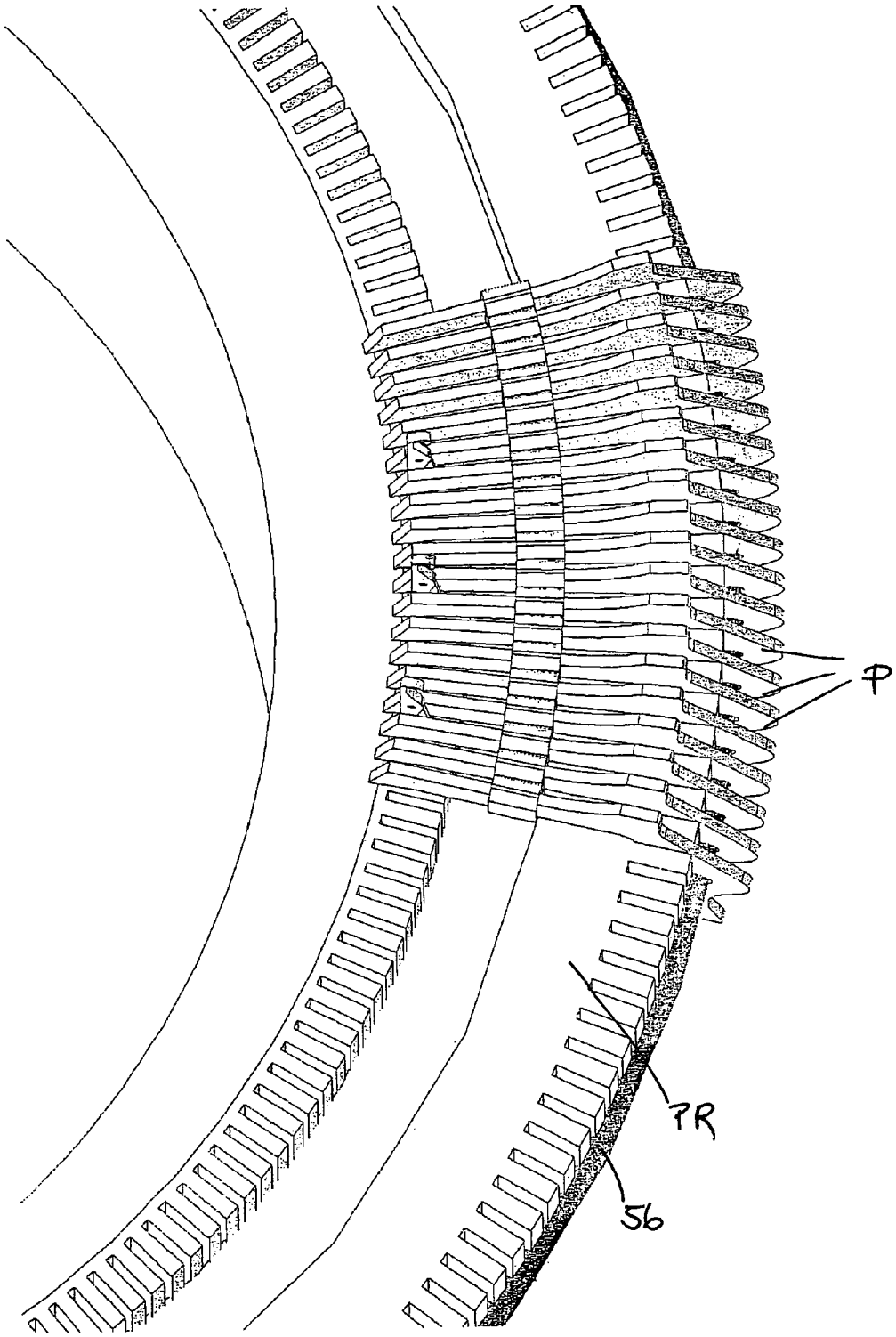

FIG. 23*b* shows a sinker of the machine according to FIG. 23*a*, which is arranged on the endless thread; and FIG. 24 shows the view from the top onto a formation of grid sinkers and onto the upper cylinder edge (Z) of the alternative embodiment according to FIG. 23*a*.

DETAILED DESCRIPTION OF THE INVENTION

The object of the invention characterized in claim 1 is to specify a single circular knitting machine, in the case of which the fixedly meeting pitches are replaced with a sinker grid system, which is flexible per se and which is oriented automatically in the needle gaps. The basic idea, which led to the invention, was to make the possible pitch accuracy in the needle cylinder to be the determining aspect for a more flexible allocation of the sinker in the functional area. The storage pitches of the sinkers could then be arranged further away on the sinker ring and the difficult taring of the tolerances of two pitches relative to one another, that is, the horizontal sinker slots would no longer be necessary. The connection of the sinker ring with the needle cylinder would be alleviated and would be possible without any problems. A more flexible sinker-grid formation is created in this manner from the storage to the needles in the cylinder. Different sinkers result, which are automatically oriented according to the needles when passing through in any system. Instead of the currently standard horizontal longitudinal movement, the sinkers are pivoted parallel to the needles. Advantageously, this has the result that, upon pushing the needles forward, the knitting loop is not only stopped, as has been the case until now, but is transported to the needle shaft in a more effective manner by means of a counter movement. In addition, the complicated sinker control by means of sinker cams, which are fixedly attached to a sinker cam plate above the rotating cylinder, becomes superfluous and the cam system takes over this task in a much more clearly arranged setup. The sinkers can furthermore be used as a template for inserting the thread into the needle hook, without having to additionally attach a thread guide. The current help from the take-up motion when casting off the old knitting loop by pushing it away by means of the sinker is replaced with a different measure. The described advantages have considerably simplifying effects on the overall design of the single circular knitting machine.

A basic idea of the invention is thus to equip the sinker ring with a plate area, which in particular does not encompass any sinker slots and which is thus substantially flat, so that the sinkers are arranged thereon so as to be movable relative to one another, wherein the sinkers are in particular supported only on the outer periphery of the sinker ring. The ends of the sinkers on the needle side can carry out movements transversally to their longitudinal axis, so as to align in the needle gaps. These transverse movements are thus not limited by the side walls of the sinker slots, which are known from the state of the art. In particular, the sinkers form a so-called sinker grid system, which is to be understood in the instant application as the plurality of sinkers, which are arranged on the sinker ring and which are in a detachable contact with one another at least at one point. The contact thereby preferably exists only in a lateral contact of adjacent sinkers, as is described below in more detail.

The invention can be used advantageously for all single circular knitting machine alternatives and considerably alleviates the demands on accuracy in the case of the ultra-fine needle pitches.

Advantageous further developments of the invention are specified in the subclaims.

The further development according to claim 2 relates to the geometric contexts in the determination of the pivot point of the sinkers (P) to the desired x-y movements of the sliding bump (47) in response to the knitting loop formation.

The further development according to claim 3 relates to the front design of the sinkers (P) for the thread insertion by means of a template (46) and of the sliding bump (47).

The further development according to claim 4 describes the possibility of the invention to hold the last knitting loop on the cast-off edge of the needle cylinder (Z) by means of the sliding bump (47) when pulling the new thread loop through.

The further development according to claim 5 relates to the design of the pivot inlet (43) of the sinkers (P) and to the embodiment of the rocker (44).

The further development according to claim 6 relates to the control of the sinkers (P) by means of the control curves (49), which are attached to a support rail (48) by means of the unit E.

The further development according to claim 7 relates to the embodiment of the sinker ring (PR) with additional guide slits for the rocker (44), which are available in the area of the control curve (49) so as to be aligned laterally with the pivot point slits (41) and also serves to stabilize the sinkers.

The further development according to claim 8 relates to the central connection of the needle cylinder (Z) to the sinker ring (PR).

The further development according to claim 9 relates to the embodiment of the sinker P as a composite element of a sinker-grid formation. For this purpose, spacing bumps H are preferably attached above the cavity between needle cylinder (Z) and sinker ring (PR) at the sinkers (P) so as to be capable of being released or spacing springs or other space maintainers, for example in the shape of U-shaped slides, such that they encompass the entire needle pitch at this location. The sinkers thus contact one another on the spacing bumps, spacing springs or space maintainers, so that the thickness of the sinkers at this location accounts for the entire needle pitch. The sinkers thereby form a sinker grid, which refers to the sinkers located next to one another, which are thus in particular not connected to one another so as not to be capable of being detached. The sinkers are in particular located next to one another in a circle of contact. A single one of these sinkers as component of this sinker grid can also be identified as grid sinker.

The further embodiment according to claim 11 relates to the stable embodiment of the sinkers (P) for the ultra-fine needle pitches. For this purpose, the sinker shaft preferably encompasses the full pitch distance above the cavity between needle cylinder (Z) and sinker ring (PR), and narrows laterally forwards for the engagement with the needle gaps, while lateral depressions, which form a guide latch (52) with the thickness of the pivot point slits (41), are preferably impressed in the back of the pivot inlet (43). It is thus possible for ultra-fine needle pitches to place the sinkers directly side by side, without providing for additional space maintainers, and to simply embody the area on the needle side to be narrower than the area, which is spaced apart from the needle.

According to a preferred embodiment, provision is made for the pivot point projection to be embodied as an endless thread, which is arranged in a revolving groove, which is arranged in the outer periphery of the sinker ring. An advantageous support of the sinkers can be attained through this.

Preferably, the endless thread is made of rubber or highly-elastic carbon or is embodied as a coil spring ring, which provides for a simple production.

A sinker according to the invention for a single circular knitting machine in each case encompasses at the end, which is spaced apart from the needle, a rocker (44) comprising an upper and a lower control bump (45) as well as a pivot inlet (43), wherein the thickness of the sinker (P) encompasses the full pitch distance at least at a distance to the end on the needle side. Through this, the sinkers are located laterally side by side at least at a distance when arranged in the machine and they are stabilized against one another, which makes it possible to use a flat plate area on the sinker ring instead of the otherwise common sinker rings comprising sinker slots, whereby the sinkers can be oriented according to the needle distances, because the transverse movements thereof are not limited by sinker slots.

According to a preferred embodiment of the invention, the sinker encompasses a spacing bump or a spacing spring or a space maintainer, which is preferably embodied as a U-shaped slide, at a distance to the end on the needle side. Through this, it is made possible to determine the desired pitch space in a simple manner.

According to an advantageous embodiment, the sinker shaft narrows laterally forwards, starting at the distance to the end on the needle side, in which it encompasses the full pitch distance, for the engagement with the needle gaps, while lateral depressions, which form a guide latch (52) with the thickness of the pivot point slits (41), are preferably impressed in the back of the pivot inlet (43). Such sinkers can be produced in a simple manner.

Exemplary embodiments of the invention will be defined by means of FIG. 1 to FIG. 24. Unless otherwise specified, all of them are embodied in an enlarged scale of approx. 5:1. The direction of rotation of the cylinder (Z) and of the sinker ring (PR) is thereby clockwise.

DETAILED DESCRIPTION OF THE FIGURES

Figure 1:
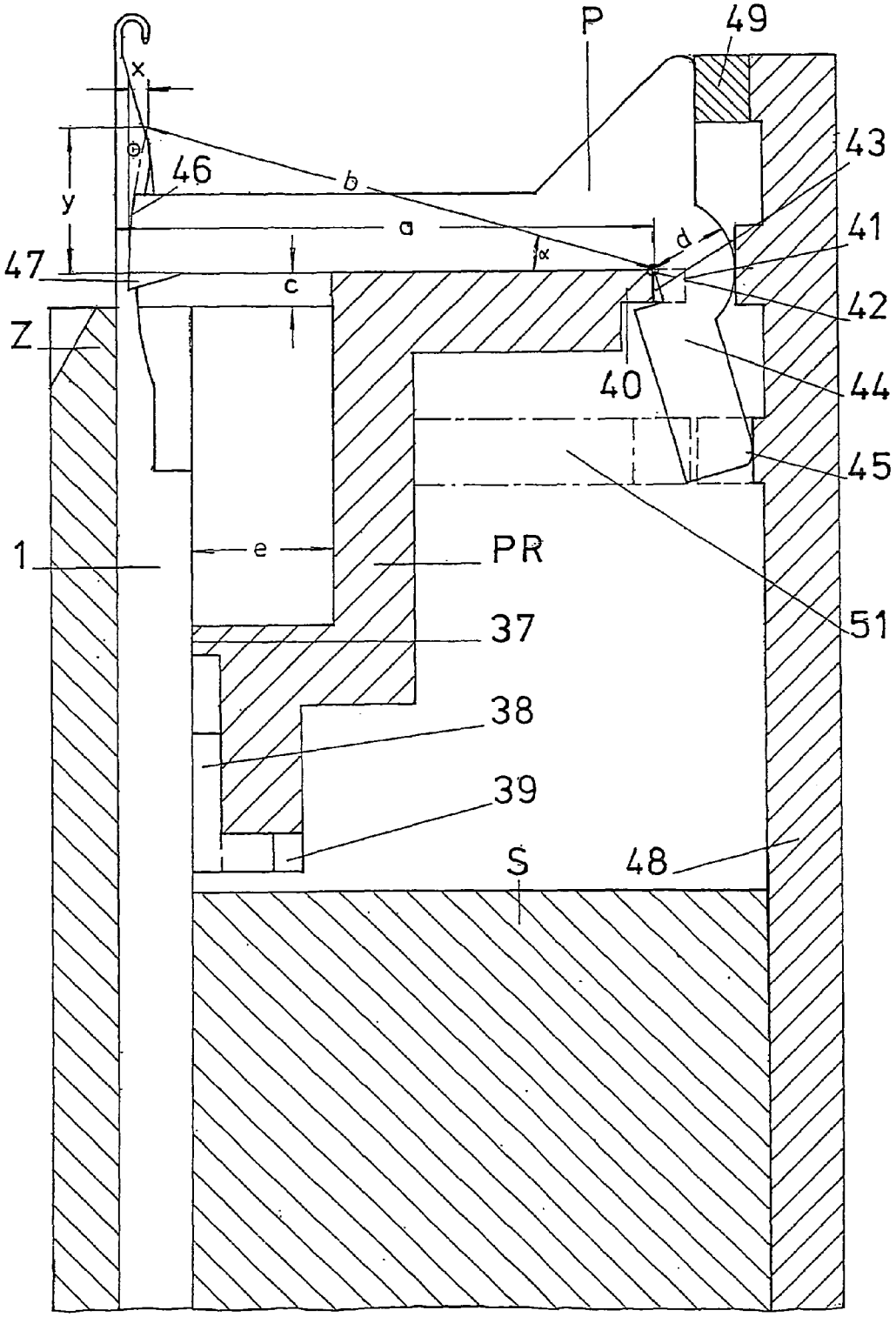
FIG. 1 is a schematic diagram of a simplified design of a single circular knitting machine comprising novel grid sinkers (P), the geometric contexts of their embodiment, the automatic orientation of the sinker ring (PR) to the needle cylinder (Z) and the central structural unit of the machine with integrated control of all of the courses of movement.

FIG. 1 is the schematic view of the design according to the invention of a simplified single circular knitting machine comprising novel grid sinkers P, which transport the knitting loops in the needle gaps via the open latches around pivot points 42, which are located spaced apart from the needle cylinder Z. It follows from the geometric illustration of the course of movement how the pivot angle ($\alpha$) of the sliding bump 47 is influenced by the length b of the sinker P and of the pivot point distance a from the needle slot base, while the angle coordinates x and y of the sliding bump 47 can additionally be determined as desired by means of the distance c to the cast-off edge. The arrangement of the pivot point 42 slightly above the cast-off edge can be advantageous with reference to the x deflection.

FIG. 1 further shows, in a sectional view, the needle cylinder Z, which can be rotated about the central axis, in the upper outer area of the cylinder ring with exposed needle slot, in which the needle 1 moves up and down in response to the knitting loop formation with known cam control. The sinker ring PR is arranged around the needle cylinder Z so as to rotate and forms a structural unit therewith, in that it is accommodated on nose projections 38 at cylinder insertion bars, as is currently the case. However, the slots of the cylinder Z and of the sinker ring PR must no longer be connected to their tolerances and the sinker ring PR must then no longer be fastened laboriously, because, as described below, the instant sinker ring PR no longer encompasses slots. It suffices to insert said sinker ring into the nose projections 38 of the cylinder insert bars at the lower front surface with the position slits 39, which arc attached at that location and which are aligned with the pivot point slits 41. A guide bulge 37 for the centering of needle cylinder Z and sinker ring PR is thereby advantageous. As is currently the case, a cavity e between the outer cylinder diameter and the sinker ring PR is necessary on the top of the sinker ring for the latch movement. Provision is now no longer made for sinker slots in the plate area, which follows outwardly. It ends with a narrow pivot point projection 40, in which pivot point slits 41 are embodied for accommodating the sinkers P. The pivot point projection 40 is thereby arranged in particular at the outer periphery of the sinker ring PR, for example below the plate area, in particular directly below the plate area. The pivot point slits 41 run in particular on the outer periphery of the sinker ring PR in longitudinal direction, while the upper side of the sinker ring PR is embodied so as to be substantially flat.

The sinkers P are embodied in an angled manner, comprising a longitudinal section arranged on the sinker ring PR having a length a and a rocker 44, which is arranged thereon in a substantially transverse or perpendicular manner.

At the transition to the rocker 44, which is attached in a perpendicular manner, the sinkers P are accommodated in the pivot point slits 41 with a pivot inlet 43 and encompass control bumps 45 for the control of the pivot movement at both ends of the rocker 44. The picot inlet 43 is thereby supported in a pivotable manner in the pivot point slits 41 below the plate area at the outer periphery of the sinker ring PR when the sinker P is arranged on the sinker ring PR. The pivot movement takes place in such a manner that the longitudinal section lifts from the plate area (see FIGS. 8 and 9). Due to the fact that sinker slots are not provided on the plate area, a movement of the longitudinal sections of the sinkers P at right angles to the longitudinal axis of the longitudinal sections and parallel to the plate area is made possible. This provides for an orientation of the ends of the sinkers on the needle side according to the pitch space of the needles.

The cam systems S, which are divided in sectors, are fixedly screw-connected to the machine plate at the periphery of the needle cylinder Z below the sinker ring PR. The needle cylinder Z rotates past it in clockwise direction. The cam jacket is simultaneously the fastening base for the support rail 48 of the control curves 49 for the sinker movement.

FIGS. 2 to 6 deal with two sinker alternatives, how they can be connected in a different manner to a grid system and to the sinker support in the sinker ring PR for ultra-fine needle pitches.

FIG. 2 is the view from the top of the grid formation and of a side section of sinkers P for the average pitch fineness with the largest range of application. The sinkers at that location all have the same strength; it is thereby slightly less than half of the needle pitch. Provision is made approximately at the outer diameter location above the cavity e at the sinkers P laterally on the shaft for spacing bumps H such that the sinkers P contact one another at this location to form a bond. The bumps can be released from the shaft or can be formed by means of a spacing spring as in the case of knitting loop transfer needles. The storage of the grid sinkers takes place according to the embodiment in FIG. 1.

The alternative of FIG. 3 is an embodiment for the ultra-fine needle pitches. Starting from e towards the rear, the sinker strength can thereby correspond to the needle pitch at this location. Towards the front, the sinkers P are laterally offset for the engagement with the needle gaps. Stable sinkers also result here in this manner.

FIG. 4 to FIG. 6 relate to the storage embodiment of FIG. 3 for ultra-fine needle pitches. The pivot point 42 of the sinker is arranged at that location in the center of the pivot point projection 40 and the sinkers encompass depressions in the area of the pivot point slits 41, so that a guide latch 52 results, which has the strength of the pivot point slits 41.

FIG. 4 is the side view of a section through a pivot point slit 41 at the pivot point projection 40 of the sinker ring PR, as well as the view from the top of a section of pivot point slits 41 on the pivot point projection 40.

The pivot point projection 40 narrows in the area of the slits on the upper and lower side, in each case by half of the pivot angle.

FIG. 5 is the view onto a side view and from the front onto the rocker 44 comprising the central pivot inlet 43 of the sinker P in the central position of the pivot angle. Lateral depressions are thereby impressed in the pivot inlet in the area of the slits 41, so that a guide latch 52 forms in the center, which can be inserted into the slits 41.

In FIG. 6, a sinker P was inserted into the pivot point slit 41.

FIG. 7 is the view from the top onto the upper cylinder edge Z with the needle slits, into which a number of needles has been drawn, and a grid formation comprising sinkers P for ultra-fine needle pitches according to FIGS. 3 to 6. The lateral cast-offs of the sinkers P are located in the gaps between the needles 1. The sinkers P thus contact one another at the distance e. The sinkers P are cast off laterally towards the end on the needle side, so that there is no contact with the sinkers P and an engagement into the space between the needles can take place. The distance between the sinkers P increases towards the end, which is spaced apart from the needle, due to the radial arrangement of the sinkers P. The illustration illustrates the simplified clear arrangement of this construction type.

FIGS. 8 and 9 illustrate the two end positions of the sinkers P in response to the knitting loop formation.

FIG. 8 shows the last phase of the knitting loop formation, in the case of which the newly created knitting loop has been transported behind the needle latch through the sliding bump 47. The upper control bump 45 thereby came into operative connection with the upper control curve 49. In contrast with the load-free upwards movement of the sliding bump 47, a resistance had to be overcome here due to the knitting loop transport. A mini slide or ball bearing, which is integrated in the peak of the control curve 49, as illustrated, instead of the movement in opposite direction of the control bump 45 can at this location preferably cause a rectified unrolling movement of the contact surfaces.

In FIG. 9, the start of a new knitting loop formation is illustrated in the next system, in the case of which the thread is inserted into the needle hook 2. The sinker P is located in the upper position and the template 46 guides the thread to the chest rise, so that it is captured by the hook 2 in response to the subsequent return movement of the needle 1. In addition, the control curves 49 and the counterbalance 50 of the sinkers P arranged therebetween are combined to form a functional unit E, which is fastened to the support rail 48.

FIGS. 10 to 14 show the course of movement of the needle and sinker in response to the formation of knitting loops.

FIG. 10 relates to the beginning of a new knitting loop formation. When the needle 1 is completely moved forward, the last knitting loop is located behind the needle latch on the shaft of the needle 1 and the sinker P is in its upper end position, so that a guide gap results between its template 46 and the needle breast 3 for the thread, which is drawn in downwards and FIG. 11 shows how the thread is guided into the needle hook 2 in response to the return movement of the needle 1 and small downwards movement of the template 46. The last knitting loop thereby reaches underneath the needle latch and begins to close it.

A loop has formed in FIG. 12 in response to the further return movement of the needle 1 in the needle hook, while the last knitting loop is clamped on the upper cylinder edge Z by means of the sliding bump 47 and remains there until the needle head releases the last knitting loop upon reaching the upper cylinder edge Z.

The needle 1 moved further back into the kinking position between FIGS. 12 and 13. The last knitting loop has thereby been cast off beyond the needle head and the new loop, which is located in the needle head, rolls to its desired size;

FIG. 13 shows a newly formed knitting loop in the needle hook 2, which is moved forwards, and the sliding bump 47, as it slightly pivots back into the capturing position.

In response to the forward movement of the needle according to FIG. 14, the new knitting loop is captured by the sliding bump 47 and is transported to the upper edge of the cylinder Z.

FIGS. 15 to 17 are illustrations of the knitting loop behavior when the loop, which is located in the needle head, is pulled through during its kinking to form a new knitting loop.

FIG. 15 shows the current behavior, in the case of which the last knitting loop can be slightly pulled into the needle slot of the cylinder Z.

In FIG. 16, the last knitting loop is held on the upper cylinder edge during the kinking and is subsequently released from the sliding bump 47 for cast-off.

In FIG. 17, a small tilt of the upper cylinder edge in the feed zone of the loop positively impacts the cast-off behavior of the last knitting loop.

FIG. 18 is the three-dimensional schematic illustration of the simplified and compact construction type single circular knitting machine with a large range of application. The sinker grid, which is joined together, protects the sensitive upper zone of the needle cylinder Z.

FIG. 19 shows an exploded view of the components needle cylinder Z with sinker ring PR, the sinker P, which can be easily accessed for insertion into the sinker ring PR, and the needle cam system S with application possibility for the support rail 48 for the control curves 49 of the sinkers.

FIG. 20 is the view from the front onto the needle cylinder (Z) with the sinker ring (PR) and a combined cam system (S) arranged in front thereof for the control of the needles and sinkers. By removing a system, the needles (1) as well as the sinkers (P) can be replaced in a easily accessible manner.

FIGS. 21 to 24 illustrates an alternative embodiment of the invention. The same reference numerals identify the same parts or parts having the same function. For the sake of clarity, not all of the reference numerals are specified in all of the figures.

The pivot point projection is formed in this embodiment by means of an endless thread 56, which is arranged in a groove 54, which rotates on the outer periphery of the sinker ring PR. An element, which is closed, is thereby identified as an endless thread 56, for example a rubber ring, a spring ring or the like. The endless thread 56 can be made of rubber, an elastomer or of highly-elastic carbon, for example. In the alternative, the endless thread 56 can also be formed as coil spring ring. The use of the endless thread 56 can make the production of the sinker ring PR to be more cost-efficient. The endless thread 56 is thereby arranged at a distance c to the plate area of the sinker ring PR, whereby the deflections x and y of the sliding bump 47 can be varied by varying the distance c.

To support the sinkers P on the sinker ring PR, the pivot point slits 41 can be designed to be longer than in the case of the first exemplary embodiment. The pivot inlet 43 in this embodiment is embodied in a substantially semicircular manner having a radius, which substantially corresponds to half of the diameter of the endless thread.

A further difference of the embodiment illustrated in FIGS. 21 to 24 is the embodiment of the sinkers P. To obtain a thickness of the sinkers, which corresponds to the complete pitch distance of the sinkers, at a distance to the end of the sinker P on the needle side, a space maintainer, which is embodied as a U-shaped slide 55, for example, can be attached to a sinker P, which has a substantially even thickness. The strength of the slide 55 is dimensioned such that the sinkers P contact one another laterally for a certain pitch at this location and a grid-forming contact ring of the sinkers P thus follows in particular. Without much effort, sinkers P can thus be retrofitted, so as to suitably prepare them for use on a machine comprising a flat plate area without sinker slots. By varying the strength of the slide 55, desired pitch distances of the sinkers can be obtained.

LIST OF REFERENCE NUMBERS

1 needle
2 needle hook
3 needle breast
4 needle slit
37 guide bulge on the sinker ring
38 nose projection on the cylinder insert bar
39 position slits at the lower front surface of the PR
40 pivot point projection on the outside of the PR outer diameter
41 pivot point slits on the sinker ring
42 pivot point in the projection on the PR
43 pivot inlet of the sinker
44 rocker of the sinker with control bumps on both ends for the pivot movement
45 control bump
46 template for the thread feed into the needle hook
47 sliding bump for knitting loop transport to needle shaft
48 support rail for sinker control unit
49 control curve
50 counterbalance of the sinker P between the control curves
51 guide rim
52 guide latch
54 peripheral groove
55 slide
56 endless thread
e cavity between cylinder and PR for latch movement
S upper part cam system (rope)
P sinker
PR plate ring
Z needle cylinder The references recited herein are incorporated herein in their entirety, particularly as they relate to teaching the level of ordinary skill in this art and for any disclosure necessary for the commoner understanding of the subject matter of the claimed invention. It will be clear to a person of ordinary skill in the art that the above embodiments may be altered or that insubstantial changes may be made without departing from the scope of the invention. Accordingly, the scope of the invention is determined by the scope of the following claims and their equitable Equivalents.

I claim:

1. A single circular knitting machine consisting of: (a) a central rotatable needle cylinder, (b) a sinker ring surrounding the central rotatable needle cylinder, the sinker ring comprising a circular arrangement of a plurality of sinkers and cam systems, wherein each sinker has a proximal end, which is proximal to the needle cylinder, and a distal end, which is distal to the needle cylinder, and corresponds to a needle, and wherein said cam systems acts to vertically raise and lower such needles, wherein each sinker comprises a rocker at the distal end, such rocker further comprising an upper and a lower control bump, and wherein each sinker comprises a recessed pivot inlet, and (c) the sinker ring comprising a pivot point projection below the sinkers at the distal end, the pivot point projection comprising a plurality of pivot point slits, each such pivot point slit extending into a corresponding pivot inlet, wherein a sinker is accommodated by each pivot point slit such that the sinker can be tilted with its pivot inlet and wherein each sinker is laterally fixed at its proximal end in a needle gap by means of a sliding bump, such that a loop of thread or yarn is transported to a shaft of the needle behind a corresponding needle latch in response to a formation of thread or yarn loops.

2. The machine of claim 1, wherein an angle of inclination (a) of the sinker and a x-y deflection of the sliding bump are determined by means of an arrangement of the pivot point of the sinker and an outer diameter of the sinker ring with distance dimensions to a needle base in relation to a cast-off edge of the cylinder.

3. The machine of claim 1, wherein each sinker comprises a template at a front, which transitions downwards into the sliding bump, for an insertion of the thread into a needle hook.

4. The machine of claim 1, wherein the sliding bump of each sinker is controlled such that it clamps the last knitting loop on the upper edge of the needle slot side walls of the cylinder when the new thread loop is pulled through.

5. The machine of claim 1, wherein each sinker forms a pivot point in said pivot inlet and is connected to a corresponding rocker, which sinker is widened upwards and downwards, and the control bumps on the end side of the sinker provide sliding surfaces for the pivot movement.

6. The machine of claim 1, further comprising a plurality of control cams fastened in a support rail on the cam system wherein each control cam is assigned to a corresponding control bump of one of the rockers, such that a counterbalance of the sinker around the pivot point is arranged between control curves.

7. The machine of claim 1, wherein the sinker ring further comprises an additional guide rim comprising slits, which are laterally aligned with the pivot point slits, in an effective range of the lower control bump.

8. The machine of claim 1, wherein the sinker ring, at its lower front surface, comprises one or more position slits, which are laterally aligned with the pivot point slits and which are insertable into the nose projections at the cylinder insertion bars, whereby the pivot point slits are oriented according to needle gaps.

9. The machine of claim 1, further comprising wherein spacing bumps or spacing springs or space maintainers are attached to the sinkers above a cavity between needle cylinder and sinker ring such that they encompass the entire needle pitch at this location.

10. The machine of claim 9, wherein a space maintainer is embodied as a U-shaped slide.

11. The machine of claim 1, wherein a sinker shaft encompasses a full pitch distance above a cavity between needle cylinder and sinker ring and narrows in front laterally for an engagement with needle gaps.

12. The machine of claim 1, wherein the sinker ring encompasses a plate area, which is embodied in particular so as to be flat.

13. The machine of claim 1, wherein the pivot point projection is embodied as an endless thread, which is arranged in a revolving groove around the outer periphery of the sinker ring.

14. The machine of claim 1, wherein the endless thread is made of rubber or highly elastic carbon or is embodied as a coil spring ring.

15. The machine of claim 1, wherein the thickness of the sinker covers a full pitch distance at least at a distance to an end on the needle side.

16. A sinker for a single circular knitting machine, wherein the sinker has a first end and a second end and, the sinker comprising (i) a rocker at the second end, such rocker further comprising an upper and a lower control bump and (ii) a pivot inlet, wherein a thickness of the sinker is adapted to cover a full pitch distance at least at a set distance from the first end of the sinker.

17. The sinker of claim 16, further comprising a spacing bump or a spacing spring or a space maintainer, at a set distance from the end on the needle side.

18. The sinker of claim 16, wherein the sinker shaft narrows laterally forward towards the end on the needle side, in which it covers a full pitch distance, for the engagement with the needle gaps.

19. The machine of claim 6, wherein an upper control cam comprises a mini slide or ball bearings.

20. The machine of claim 12, wherein lateral depressions, which form a guide latch with the thickness of the pivot point slits, are impressed in a back of the pivot inlet.

21. The sinker of claim 17, wherein the space maintainer is embodied as a U-shaped slide.

22. The sinker of claim 18, wherein lateral depressions, which form a guide latch with a thickness of the pivot point slits, are impressed in a back of the pivot inlet.

* * * * *